US005170010A

United States Patent [19]

Aldissi

[11] Patent Number: 5,170,010

[45] Date of Patent: Dec. 8, 1992

[54] SHIELDED WIRE AND CABLE WITH INSULATION HAVING HIGH TEMPERATURE AND HIGH CONDUCTIVITY

[75] Inventor: Mahmoud Aldissi, Colchester, Vt.

[73] Assignee: Champlain Cable Corporation, Winooski, Vt.

[21] Appl. No.: 720,140

[22] Filed: Jun. 24, 1991

[51] Int. Cl.[5] ..... H01B 7/34

[52] U.S. Cl. ..... 174/36; 174/106 R; 174/106 SC

[58] Field of Search ..... 174/34, 36, 106 R, 106 SC, 174/102 SC, 110 PC; 252/511

[56] References Cited

U.S. PATENT DOCUMENTS

| | | | |
|---|---|---|---|
| 3,735,025 | 5/1973 | Ling et al. | 174/120 SC |
| 4,041,237 | 8/1977 | Stine et al. | 174/110 FC X |
| 4,183,010 | 1/1980 | Miller | 174/110 FC X |
| 4,317,001 | 2/1982 | Silver et al. | 174/102 SC |
| 4,347,487 | 8/1982 | Martin | 174/36 X |
| 4,383,225 | 5/1983 | Mayer | 174/36 X |
| 4,499,438 | 2/1985 | Cornelius et al. | 174/36 X |
| 4,642,417 | 2/1987 | Ruthrof et al. | 174/36 |
| 4,871,883 | 10/1989 | Guiol | 174/36 |
| 4,970,488 | 11/1990 | Horiike et al. | 174/106 R |

*Primary Examiner*—Morris H. Nimmo
*Attorney, Agent, or Firm*—Salzman & Levy

[57] ABSTRACT

The present invention features a new type of filter line cable. The new filter line in one embodiment thereof, comprises a cable having a conductive core member. A first insulation layer is disposed over the conductive core member. A first shielding layer of ferrite particles dispersed within a polymeric matrix is then overlayed the first insulation layer. A second insulation layer is then disposed over the first shielding layer. A second shielding layer of braided or served metallic mesh overlays the second insulation layer. A jacket layer overlays the second shielding layer and comprises a cross-linked, polymeric matrix containing approximately between 10 wt. % and 35 wt. % carbon black.

22 Claims, 3 Drawing Sheets

SHIELDED WIRE AND CABLE WITH INSULATION HAVING HIGH TEMPERATURE AND HIGH CONDUCTIVITY

FIELD OF THE INVENTION

The invention relates to an insulation for shielded wire and cable having high loadings of carbon black, and more particularly to a conductive jacket insulator material that is disposed over the braided shield of filter line wire or cable to enhance its shielding range.

BACKGROUND OF THE INVENTION

Wire providing microwave/radar frequency attenuation is referred to in the wire and cable trade as "filter line." The measurement of the attenuation (insertion loss) upon a given wire's performance relates to the effect that the filter line has upon interference signals conducted down the wire.

Properly shielded filter line provides protection against radiated EMI. Noise currents and voltages are induced on the conductors of the cables when a radiated field causes interference. Filter line can attenuate such noise when it is shielded by metallic braid or other forms of conventional shield layering. The shielding effect can be measured by transfer impedance techniques. the efficacy of filter line wire or cable by providing such shielded wire or cable with additional conductive layers of insulation, such as (1) a jacket of polymeric material that is conductive by reason of high loadings of carbon black; and (2) an additional polymeric layer of insulation containing ferrite particles disposed below the metallic mesh shielding layer.

The high loadings of carbon black are in the range of approximately between 10 wt.% and 35 wt.% of its polymeric matrix. In the past, it has been impossible to extrude such high carbon-filled polymers into insulation for wire and cable. The present invention extrudes the carbon black filled polymeric layer at approximately 580° to 600° F. The higher loaded carbon black polymer is extrudable by virtue of the control of the cross-linking of the carbon black within the polymeric matrix. The polymer, an ethylene-tetrafluoroethylene (ETFE), is mixed with a cross-linking agent, triallylisocyanurate (TAIC), and is additionally radiationally cross-linked. This cross-linking is carefully controlled to allow the carbon black to become part of the polymer matrix, while keeping the viscosity of the crystalline material within extrudable range.

High frequency signals conducted down this wire are partially absorbed by the ferrite particle shield layer. Electromagnetic waves penetrate this shield layer up to the ferrite particles, and are then dissipated by lattice vibration or photon emission.

Protection against radiated EMI is provided by the carbon black of the jacket layer via the percolating structure that consists of large loadings of the carbon black.

DISCUSSION OF RELATED ART

In U.S. Pat. No. 5,000,875, issued to Robert Kolouch on Mar. 19, 1991, entitled "Conductive Filled Fluoropolymer," a carbon black-filled tetrafluoroethylene copolymer is shown. The ranges contemplated for the carbon black loading are generally in the range of from 1 to 20% by weight. However, it is demonstrated by the data presented therein that loadings of greater than approximately 10% are not extrudable due to the high melt index. In fact, the patent suggests injection molding the materials, because extrusion is not available with the viscosities presented by the fabricated materials.

The present invention, on the other hand, has been able to extrude the higher loadings previously eschewed for this type of material, by virtue of the control of the cross-linking of the carbon black within the polymeric matrix. The polymer, a ethylene-tetrafluoroethylene (ETFE), is mixed with a cross-linking agent, TAIC, and is additionally radiationally cross-linked. This cross-linking is carefully controlled to allow the carbon black to become part of the polymer matrix, while keeping the viscosity of the crystalline material within extrudable range. The invention has extruded the ETFE as a jacket for filter line cable, and further has combined same with an additional layer of ferrite filled insulation disposed below the standard wire mesh layer. All this is accomplished with the purpose of enhancing or otherwise expanding the frequencies in which such cable can be employed.

SUMMARY OF THE INVENTION

In accordance with the present invention, there is provided a new type of filter line cable. The new filter line cable in one embodiment thereof, comprises a conductive core member with a first insulation layer disposed over the conductive core member. A first shielding layer, comprising ferrite particles dispersed within a polymeric matrix, is then overlayed the first insulation layer. A second insulation layer is then disposed over the first shielding layer. A second shielding layer, comprising a braided or served metallic mesh. overlays the second insulation layer. A jacket layer overlays the second shielding layer and comprises a cross-linked, polymeric matrix containing approximately between 10 wt. % and 35 wt. % carbon black.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENT

Generally speaking, the invention features a shielded wire and cable article having enhanced shielding effectiveness due to the overlay of a filter line wire or cable with a conductive polymer jacket containing large loadings of carbon black. The filter line wire or cable article is also enhanced by a conductive insulation layer that contains ferrite particles disposed below the metallic mesh shielding. The added conductive insulation layers provide shielding in an extended frequency range.

Figure 1:
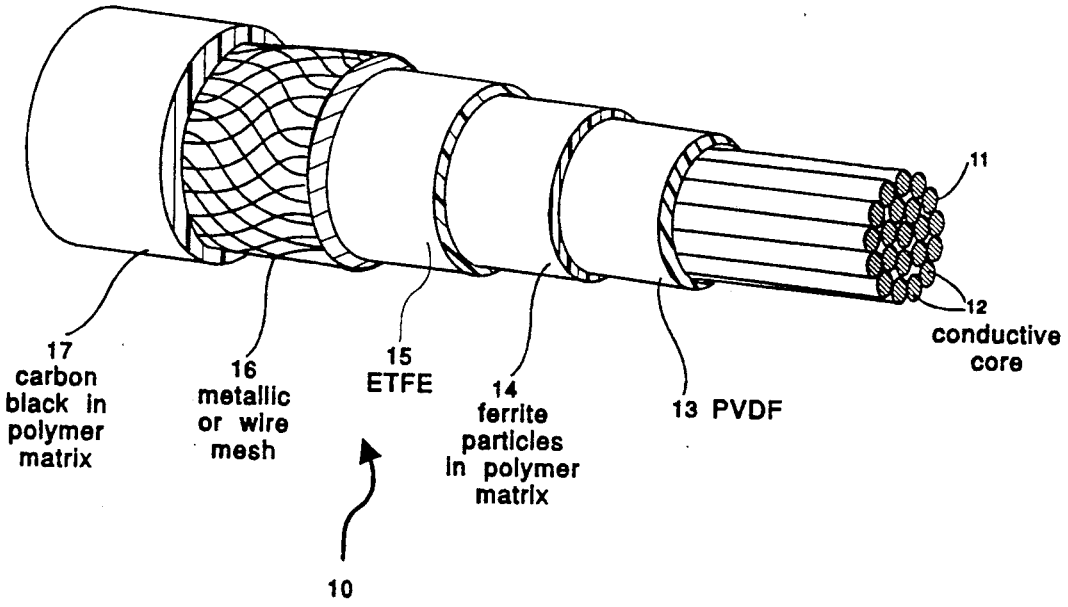
FIG. 1 illustrates a partial cutaway, perspective view of a typical shielded cable article fabricated in accordance with the shield materials of the present invention.

Now referring to FIG. 1, a cable 10 is shown in partial cut-away perspective view. The cable 10 has a conductive core member 11, which contains one or more electrically conductive wires 12. The wires 12 can be straight bundled, or twisted together. The conductive wires 12 may be bare or each wire 12 may have a layer of insulation (not shown). The entire conductive core 11 may also be covered by a primary insulation layer 13 of polyvinylidene fluoride PVDF (Kynar).

A first shielding layer 14 is layered over the primary insulation layer 13. The shielding layer 14 contains ferrite particles in a polymer matrix. The ferrite filled polymer layer 14, in accordance with the invention, provides enhanced shielding to the cable 10 by extending the frequency range that standard shield layers provide. The matrix comprises approximately between 10 to 85% by weight of ferrite particles. The ferrite particles may be metal coated and the metal coating can range from approximately 10 to 85% of the entire particle weight.

Over the shielding layer 14 is provided a second layer of insulation 15 comprising ETFE. A layer of wire or metallic mesh 16 is then braided or served over insulation layer 15. The metallic mesh 16 is then jacketed with a conductive shield layer 17 comprising a polymeric matrix containing a high loading of carbon black in accordance with this invention. The polymeric matrix comprises a material having approximately 10 to 85% by weight of the first shielding layer 14. The jacket layer 17 can comprise ETFE, FEP, or other fluorocarbon polymer that is loaded with carbon black in an approximate range of between 10 wt. % to 35 wt. %. The highly loaded carbon black fluorocarbon polymer can be extruded for the first time by virtue of the control of the cross-linking of the carbon black within the polymeric matrix. The polymer, an ethylene-tetrafluoroethylene (ETFE), is mixed with a cross-linking agent, TAIC, and is additionally radiationally cross-linked. This cross-linking is carefully controlled to allow the carbon black to become part of the polymer matrix, while keeping the viscosity of the crystalline material within extrudable range. This invention is expected to work with other ETFE cross-linking agents such as triallylcyanurate (TAC).

The shielding layer 14 provides shielding for RFI/EMI or microwave/radar interferences. The metal-coated ferrite particles can be bound in a fluorinated rubbery elastomer such as vinylidene fluoride-hexafluoropropene copolymer (DuPont tradename: Viton). Other polymer matrix materials are of course possible.

A typical wire or cable article of this invention was manufactured according to the following example:

EXAMPLE I

To a conductive core 11 comprising 19×34 strands of nickel/copper wire, 22 AWG, having an O.D.=0.03", a layer 13 of primary insulation is applied. The primary insulation consists of irradiated, cross-linked PVDF (Kynar) of 0.003" wall thickness. Over this is applied a shielding layer 14 comprising a ferrite-filled polymer matrix having the following formulation by weight: Viton 13%, poly(ethylene-co-methyl methacrylate) 2%, TAIC cross-linking agent 3%, and silver-coated MnZn ferrite 82%. The shielding layer 14 is irradiated, cross-linked and extruded over layer 13, and has a thickness of about 0.005". A layer of insulation 15 is wrapped over the shielding layer 14, and comprises ETFE having a wall thickness of approximately 0.005".

Over the layer of insulation 15 is disposed a metallic mesh layer 16 that is braided or served. The metallic mesh layer 16 covers the insulation layer 15 approximately 90% or more. A carbon black filled polymer layer 17 is then extruded over the metallic mesh layer 16 to a thickness of approximately 0.006". The carbon black is loaded in a copolymer matrix comprising ETFE 70 wt. % and TAIC 3 wt. % (cross-linking agent). The carbon black is loaded in a weight percentage range of approximately between 10 wt. % to 35 wt. %. The extrusion is performed at a temperature of between 580 and 600° F. The radiational cross-linking, combined with the cross-linking agent, TAIC, makes possible the extrusion of the highly filled carbon black polymer material by virtue of lowering the viscosity to a manageable level.

In accordance with this invention, it is also contemplated to manufacture a shielded wire and cable article that does not provide shield layer 14 and insulation layer 15, in order to reduce the size of the wire or cable.

Figure 2:
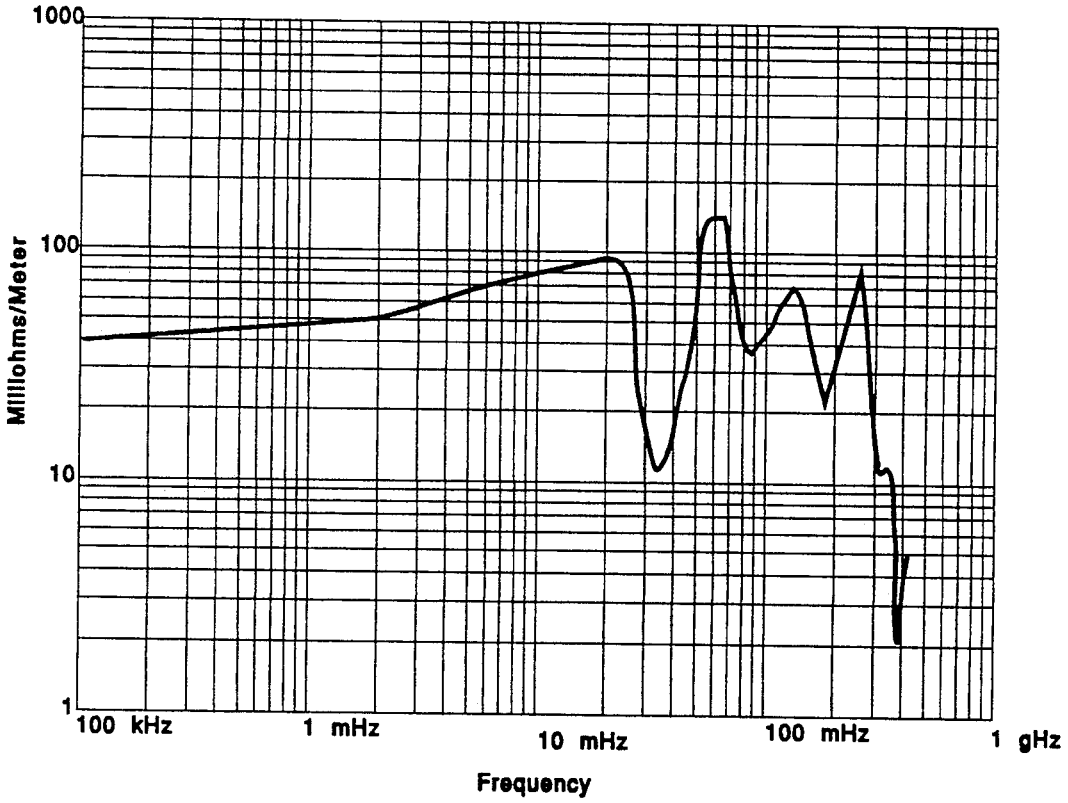
FIG. 2 depicts a graph of the surface transfer impedance over frequency range for the shielded cable article shown in FIG. 1.

Referring to FIG. 2, a graph of the surface transfer impedance versus the frequency range is presented for the shielded cable article depicted in Example I. It will be observed that the frequency range of the modified filter line cable is enhanced.

The shielded filter line cable of the invention, shown in FIG. 1, has the following physical characteristics:

density: 1.65 grams/cm$^3$;
tensile strength 3,388 psi;
elongation: 75%;
resistivity: 35 ohm-cm.

Figure 3:
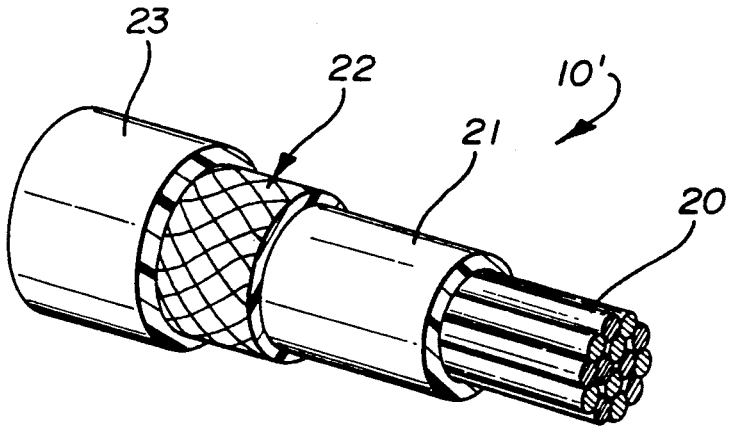
FIG. 3 depicts a second embodiment of the cable article of the invention as shown in FIG. 1, illustrated in a partial cutaway, perspective view.

Now referring to FIG. 3, a second embodiment of the cable article of this invention is shown. A cable 10' is depicted with a conductive core 20 over which is disposed an insulation layer 21. A braided or served metallic mesh shielding layer 22 is disposed over insulation layer 21. A jacketing layer 23 is then overlayed insulation layer 22. The jacketing layer comprises a polymeric matrix containing approximately between 15 wt. % and 20 wt. % carbon black.

Figure 4A:
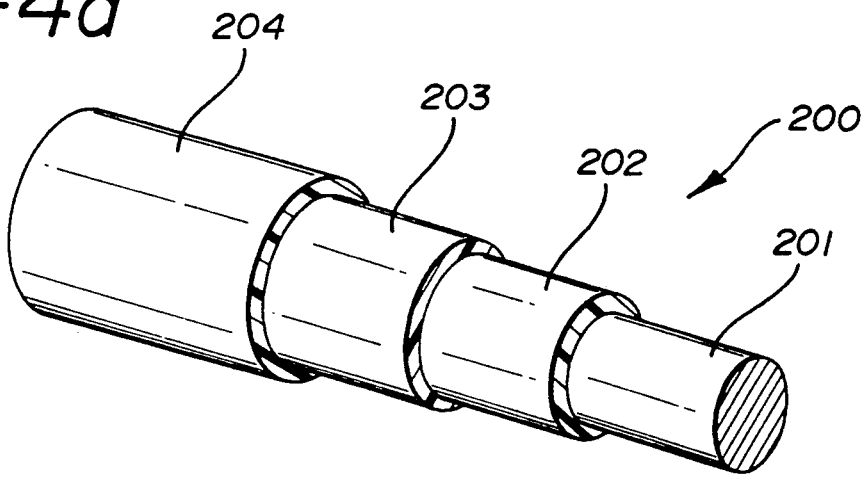
FIGS. 4*a* and 4*b* depict a third embodiment of the invention shown in FIG. 1, illustrating in a partial cutaway, a two stage construction in perspective view of the cable article.
Figure 4B:
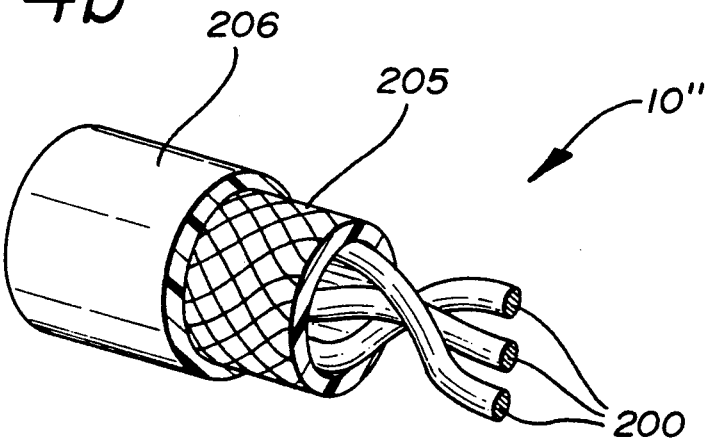

A third embodiment of the invention is depicted in FIGS. 4*a* and 4*b*. The cable article 10" (FIG. 4*b*) is shown constructed in two stages. First, a plurality of core members 200 are constructed according to FIG. 4*a*. The core members 200 each comprise a conductive wire 201 over which is disposed a first layer of insulation 202. Over the insulation layer 202 is layered a first shield layer 203 comprising ferrite particles dispersed within a polymer matrix. Over the first shield layer 203 is disposed a second insulation layer 204.

The plurality of core members 200 are then twisted or cabled together, as illustrated in FIG. 4*b*. The twisted or cabled core members then form a central core member about which is disposed a second shield layer 205 comprising a braided or served metallic mesh. Overlaying the second shield layer 205 is a final jacket layer 206 comprising a cross-linked polymeric matrix containing approximately between 10 wt. % and 35 wt. % carbon black.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the current invention, what is desired to be protected by Letters Patent is presented by the subsequently appended claims.

What is claimed is:

1. A shielded wire or cable article having EMI and RFI shielding, comprising:

a) a conductive core member;

b) a first insulation layer disposed over said conductive core member;

c) a first shielding layer overlaying said first insulation layer and comprising ferrite particles dispersed within a polymeric matrix;

d) a second insulation layer disposed over said first shielding layer;

e) a second shielding layer overlaying said second insulation layer and comprising a braided or served metallic mesh; and f) a jacket layer overlaying said second shielding layer and comprising a cross-linked polymeric matrix containing approximately between 10 wt. % and 35 wt. % carbon black.

2. The shielded wire or cable article having EMI and RFI shielding in accordance with claim 1, wherein said conductive core member further comprises at least one strand of nickel plated copper wire.

3. The shielded wire or cable article having EMI and RFI shielding in accordance with claim 1, wherein said second shielding layer comprises a metallic mesh having approximately at least 90% coverage over said second insulation layer.

4. The shielded wire or cable article having EMI and RFI shielding in accordance with claim 1, wherein said first shielding layer comprises ferrite particles dispersed in a polymeric matrix comprising a fluorinated elastomer.

5. The shielded wire or cable article having EMI and RFI shielding in accordance with claim 1, wherein said first shielding layer comprises ferrite particles dispersed in a polymeric matrix comprising a fluorinated elastomer.

6. The shielded wire or cable article having EMI and RFI shielding in accordance with claim 1, wherein said polymeric matrix comprises a material having approximately 10 to 85% by weight of the first shielding layer.

7. The shielded wire or cable article having EMI and RFI shielding in accordance with claim 1, wherein said first insulation layer comprises poly vinylidene fluoride.

8. The shielded wire or cable article having EMI and RFI shielding in accordance with claim 1, wherein said second insulation layer comprises a polymeric material containing ethylene/tetrafluoroethylene copolymer.

9. The shielded wire or cable article having EMI and RFI shielding in accordance with claim 1, wherein said cross-linked, polymeric matrix of said jacket layer is radiationally cross-linked.

10. The shielded wire or cable article having EMI and RFI shielding in accordance with claim 9, wherein said cross-linked, polymeric matrix of said jacket layer comprises a cross-linking agent.

11. The wires or cables described in claim 10 wherein said cross-linking agent comprises a material selected from a group consisting of: triallylisocyanurate (TAIC) and triallylcyanurate (TAC).

12. The shielded wire or cable article having EMI and RFI shielding in accordance with claim 1, wherein said jacket insulation layer comprises a polymeric matrix containing ethylene/tetrafluoroethylene copolymer.

13. A shielded cable article having EMI and RFI shielding, comprising:

a) a plurality of conductive core members that are twisted or cabled together to form a central core member, each of said twisted core members overlayed with:

i) a first insulation layer disposed over each of said conductive core members;

ii) a first shielding layer overlaying each of said first insulation layers and comprising ferrite particles dispersed within a polymeric matrix;

iii) a second insulation layer disposed over each of said first shielding layers ;

b) a second shielding layer overlaying said central core members of (a), and comprising a braided or served metallic mesh; and c) a jacket layer overlaying said second shielding layer and comprising a crosslinked polymeric matrix containing approximately between 10 wt. % and 35 wt. % carbon black.

14. The shielded wire or cable article having EMI and RFI shielding in accordance with claim 13, wherein said conductive core members further comprise at least one strand of nickel plated copper wire.

15. The shielded wire or cable article having EMI and RFI shielding in accordance with claim 13, wherein said second shielding layer comprises a metallic mesh having approximately at least 90% coverage over said second insulation layer.

16. An extruded shielded wire or cable article having EMI and RFI shielding, comprising:

a) a conductive core member;

b) an insulation layer disposed over said conductive core member;

c) a shielding layer overlaying said insulation layer and comprising a braided or served metallic mesh; and d) a jacket layer overlaying said shielding layer and comprising a cross-linked, polymeric matrix comprising a fluorinated polymer, or fluorinated copolymers, containing approximately between 15 wt. % and 20 wt. % carbon black.

17. The shielded wire or cable article having EMI and RFI shielding in accordance with claim 16, wherein said jacket layer comprises a polymeric matrix containing ethylene/tetrafluoroethylene copolymer.

18. The shielded wire or cable article having EMI and RFI shielding in accordance with claim 16, wherein said shielding layer comprises a metallic mesh having approximately at least 90% coverage over said insulation

19. The shielded wire or cable article having EMI and RFI shielding in accordance with claim 16, wherein said conductive core member further comprises at least one strand of nickel plated copper wire.

20. The shielded wire or cable article having EMI and RFI shielding in accordance with claim 16, wherein said cross-linked, polymeric matrix of said jacket layer is radiationally cross-linked.

21. The shielded wire or cable article having EMI and RFI shielding in accordance with claim 20, wherein said cross-linked, polymeric matrix of said jacket layer comprises a cross-linking agent.

22. The shielded wires or cables described in claim 21 wherein said cross-linking agent comprises a material selected from a group of materials consisting of: triallylisocyanurate (TAIC) and triallycyanurate (TAC).

* * * * *